US009702192B2

(12) United States Patent
Wicks et al.

(10) Patent No.: US 9,702,192 B2
(45) Date of Patent: Jul. 11, 2017

(54) METHOD AND APPARATUS OF DISTRIBUTED SYSTEMS FOR EXTENDING REACH IN OILFIELD APPLICATIONS

(75) Inventors: Nathan Wicks, Somerville, MA (US); Jahir Pabon, Somerville, MA (US); Francois Auzerais, Boston, MA (US); John David Rowatt, Harvard, MA (US); Shunfeng Zheng, Katy, TX (US); Rex Burgos, Richmond, TX (US); Robin Mallalieu, Sugar Land, TX (US); Zheng Rong Xu, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 633 days.

(21) Appl. No.: 13/355,103

(22) Filed: Jan. 20, 2012

(65) Prior Publication Data

US 2013/0186619 A1 Jul. 25, 2013

(51) Int. Cl.
*E21B 7/24* (2006.01)
*E21B 4/00* (2006.01)
(Continued)

(52) U.S. Cl.
CPC ..... *E21B 4/003* (2013.01); *E21B 4/02* (2013.01); *E21B 4/06* (2013.01); *E21B 7/24* (2013.01); *E21B 31/005* (2013.01)

(58) Field of Classification Search
CPC ..... E21B 7/24; E21B 31/005; E21B 28/00; E21B 43/003; E21B 4/02; E21B 4/003; E21B 4/06
(Continued)

(56) References Cited

U.S. PATENT DOCUMENTS 3,076,153 A 1/1963 Rieckman et al.
3,155,163 A 11/1964 Bodine, Jr.
(Continued)

FOREIGN PATENT DOCUMENTS

GB 2275342 A 8/1994
WO 9735093 A1 9/1997
(Continued)

OTHER PUBLICATIONS

Sola, K. I., and Lund, B., "New Downhole Tool for Coiled Tubing Extended Reach," SPE 60701, SPE/ICoTA Coiled Tubing Roundtable, Apr. 2000: pp. 1-8.
(Continued)

*Primary Examiner* — Kenneth L Thompson
*Assistant Examiner* — David Carroll
(74) *Attorney, Agent, or Firm* — Bridget M. Laffey

(57) ABSTRACT

Apparatus and a method for delivering a rod in a cylinder including propagating a rod in a cylinder along the interior of the cylinder, and introducing a motion in an orientation orthogonal to a length of the rod, wherein the motion comprises multiple motion sources along the length of the rod, and wherein the multiple motion sources comprise a control system that controls at least one of the motion sources. An apparatus and method for delivering a rod in a cylinder including a cylinder comprising a deviated portion, a rod comprising a length within the cylinder, multiple motion sources positioned along the length of the rod, and a control system in communication with at least one of the motion sources, wherein the control system controls the location of frictional contact between the rod and cylinder over time.

24 Claims, 8 Drawing Sheets

(51) Int. Cl.
*E21B 4/02* (2006.01)
*E21B 4/06* (2006.01)
*E21B 31/00* (2006.01)

(58) Field of Classification Search
USPC ..... 166/77.1, 77.2, 177.1, 177.2, 249, 301; 175/62
See application file for complete search history.

(56) References Cited

U.S. PATENT DOCUMENTS

| | | | | |
|---|---|---|---|---|
| 3,810,425 | A | 5/1974 | Post | |
| 4,384,625 | A | 5/1983 | Roper et al. | |
| 4,574,888 | A | 3/1986 | Vogen | |
| 4,576,229 | A | 3/1986 | Brown | |
| 4,667,742 | A | 5/1987 | Bodine | |
| 4,890,682 | A | 1/1990 | Worrall et al. | |
| 4,913,234 | A | 4/1990 | Bodine | |
| 5,448,911 | A | 9/1995 | Mason | |
| 6,009,948 | A | 1/2000 | Flanders et al. | |
| 6,152,222 | A * | 11/2000 | Kyllingstad | E21B 4/14 166/177.6 |
| 6,412,560 | B1 | 7/2002 | Bernat | |
| 6,439,318 | B1 | 8/2002 | Eddison et al. | |
| 6,464,014 | B1 | 10/2002 | Bernat | |
| 6,550,536 | B2 | 4/2003 | Bernat | |
| 6,571,870 | B2 | 6/2003 | Zheng et al. | |
| 6,845,818 | B2 | 1/2005 | Tutuncu et al. | |
| 6,907,927 | B2 | 6/2005 | Zheng et al. | |
| 7,139,219 | B2 | 11/2006 | Kollé et al. | |
| 7,219,726 | B2 | 5/2007 | Zheng et al. | |
| 7,293,614 | B2 | 11/2007 | Rose | |
| 7,458,267 | B2 * | 12/2008 | McCoy | 73/587 |
| 7,575,051 | B2 | 8/2009 | Stoesz et al. | |
| 7,637,321 | B2 | 12/2009 | Zazovsky et al. | |
| 7,708,088 | B2 | 5/2010 | Allahar et al. | |
| 7,757,793 | B2 | 7/2010 | Voronin et al. | |
| 7,874,362 | B2 | 1/2011 | Coates et al. | |
| 8,039,422 | B1 * | 10/2011 | Al-Zahrani | 507/90 |
| 8,042,623 | B2 | 10/2011 | Quernheim et al. | |
| 2005/0155758 | A1 | 7/2005 | Webb et al. | |
| 2005/0178558 | A1 | 8/2005 | Kolle et al. | |
| 2005/0230101 | A1 * | 10/2005 | Zheng et al. | 166/177.6 |
| 2005/0257931 | A1 | 11/2005 | Mody et al. | |
| 2005/0284624 | A1 | 12/2005 | Libby et al. | |
| 2006/0054315 | A1 | 3/2006 | Newman | |
| 2006/0101914 | A1 * | 5/2006 | McCoy | 73/587 |
| 2007/0256828 | A1 | 11/2007 | Birchak et al. | |
| 2008/0073085 | A1 * | 3/2008 | Lovell et al. | 166/377 |
| 2008/0251254 | A1 * | 10/2008 | Lynde et al. | 166/301 |
| 2009/0166026 | A1 * | 7/2009 | Akselberg | 166/178 |
| 2009/0260822 | A1 * | 10/2009 | Stoesz et al. | 166/301 |
| 2010/0276204 | A1 | 11/2010 | Connell et al. | |
| 2011/0120772 | A1 | 5/2011 | McLoughlin et al. | |
| 2011/0139445 | A1 * | 6/2011 | Fripp et al. | 166/250.15 |
| 2011/0180265 | A1 * | 7/2011 | Shand | 166/345 |
| 2011/0203395 | A1 | 8/2011 | Pfahlert | |
| 2012/0048621 | A1 | 3/2012 | Stewart et al. | |
| 2012/0241219 | A1 | 9/2012 | Wiercigroch | |
| 2012/0318531 | A1 | 12/2012 | Shampine et al. | |
| 2013/0160991 | A1 | 6/2013 | Gregory et al. | |
| 2013/0199794 | A1 * | 8/2013 | Lane et al. | 166/372 |
| 2014/0069639 | A1 | 3/2014 | Mackenzie et al. | |

FOREIGN PATENT DOCUMENTS

| | | | |
|---|---|---|---|
| WO | 2004/072437 | A1 | 8/2004 |
| WO | 2010125405 | | 11/2010 |
| WO | WO2010125405 | * | 11/2010 |

OTHER PUBLICATIONS

Robertson, L., Mason, C. J., Sherwood, A. S., and Newman, K. R., "Dynamic Excitation Tool: Developmental Testing and CTD Field Case Histories," SPE 89519, SPE/ICoTA Coiled Tubing Conference and Exhibition, Mar. 2004: pp. 1-16.

Castaneda, J. C., Schneider, C. E., and Brunskill, D., "Coiled Tubing Milling Operations: Successful Application of an Innovative Variable Water Hammer Extended-Reach BHA to Improve End Load Efficiencies of a PDM in Horizontal Wells," SPE 143346, SPE/ICoTA Coiled Tubing Conference & Well Intervention Conference and Exhibition, Apr. 2011: pp. 1-19.

International Search Report and Written Opinion of PCT Application No. PCT/US2013/020118 dated Apr. 12, 2013: pp. 1-10.

Dupriest, et al., "Design Methodology and Operation Practices Eliminate Differential Sticking", SPE 128129—IADC/SPE Drilling Conference and Exhibition, New Orleans, Louisiana, USA, 2010, pp. 1-13.

Newman, "Vibration and Rotation Considerations in Extending Coiled-Tubing Reach", SPE 106979—SPE/ICoTA Coiled Tubing and Well Intervention Conference and Exhibition, The Woodlands, Texas, U.S.A., 2007, pp. 1-9.

Parry, "Numerical Prediction Method for Growth and Deformation of Filter Cakes", Journal of Fluids Engineering, vol. 128, Nov. 2006, pp. 1259-1265.

Stoesz, et al., "Low-Frequency Downhole Vibration Technology Applied to Fishing Operations", SPE 63129—SPE Annual Technical Conference and Exhibition, Dallas, Texas, 2000, pp. 1-7.

Underhill, "A Predictive Model for Wireline Tool Sticking", SWS-HPC, Engineering Report: Advanced Studies Engineering Report #17, Jun. 19, 1997, 40 pages.

Sherwood, "Differential pressure sticking of drill string", AIChE Journal, vol. 44, No. 3, Mar. 1998, pp. 711-721.

International Search Report and Written Opnion issued in PCT/US2013/073223 on Mar. 26, 2014, 12 pages.

Russian Decision on Grant for corresponding Russian Patent Application Serial No. 2014134066, dated Apr. 21, 2017 English Translation, 12 pages.

* cited by examiner

METHOD AND APPARATUS OF DISTRIBUTED SYSTEMS FOR EXTENDING REACH IN OILFIELD APPLICATIONS

FIELD

Embodiments relate to methods and apparatus for moving a rod through a cylinder. Some embodiments relate to coiled tubing for oil field services and some embodiments relate to maintaining pipes containing hydrocarbons.

BACKGROUND

Helical buckling thwarts the efforts of many who aspire to resolve wellbore or pipe problems with mechanical equipment that utilizes a long, flexible rod or tube. Coiled tubing operations (CT) especially encounter helical buckling problems when the tubing is of extended length in deviated wellbores. This problem often limits the extent of reach in extended reach coiled tubing operations. Coiled tubing may experience helical buckling as the tubing travels through high friction regions of a wellbore or through horizontal regions of a wellbore. In conventional coiled tubing operations, the tubing is translated along the borehole either via gravity or via an injector pushing from the surface. For an extended reach horizontal wellbore, an axial compressive load will build up along the length of the coiled tubing due to frictional interactions between the coiled tubing and the borehole wall. A typical axial load 100 as a function of measured depth 102 is plotted in FIG. 1. This wellbore has a 4000 foot vertical section, a 600 foot, 15 degree per 100 foot dogleg from vertical to horizontal, and then continues horizontal until the end.

If the horizontal section of the wellbore is sufficiently long, the axial compressive load 100 will be large enough to cause the coiled tubing to buckle. The first buckling mode is referred to as "sinusoidal buckling"—in this mode, the coiled tubing snakes along the bottom of the borehole with curvature in alternating senses. This is a fairly benign buckling mode, in the sense that neither the internal stresses nor frictional loads increase significantly. As the axial compressive load 100 continues to increase, the coiled tubing will buckle in a second buckling mode. This buckling mode is called "helical buckling"—this mode consists of the coiled tubing spiraling or wrapping along the borehole wall. This buckling mode can have quite severe consequences—once the coiled tubing begins to buckle helically, the normal force exerted by the borehole wall on the tubing increases very quickly. This causes a proportional increase in frictional loading, which in turn creates an increase in axial compressive load 100. Once helically buckling has initiated, the axial compressive load 100 increases very quickly to a level such that the tubing can no longer be pushed into the whole. This condition is termed "lock-up." A plot of axial stress 200 as a function of measured depth 202 for a coiled tubing which is almost in a locked up state is shown in FIG. 2.

Coiled tubing (CT) operations employ several techniques for maximizing the depth of penetration in extended reach wells. Vibrators are used in conjunction with CT to increase the depth of penetration in extended reach wells. These vibrators are made up to the bottomhole assembly (BHA) connected at the end of the CT string and are normally activated by pumping fluid through them. The oscillating action caused by the vibrator results in reduced drag forces on the pipe as it is pushed into the wellbore from the surface. One of the more effective solutions uses a vibrator as part of the bottomhole assembly (BHA). The oscillations caused by the vibrator reduce the excessive drag on the CT string in high angle wellbore trajectories. This reduction in drag often delays the onset of helical buckling. Effectively, this drag reduction has been found to be equivalent to as much as 30% of the friction coefficient between the wellbore wall and the CT. Thus, drag force reduction increases the CT's ability to go further in an extended reach well. However, depending on the wellbore configuration and the CT string characteristics, as well as the vibrator's amplitude and frequency of the oscillations produced, the position of the vibrator at the terminal end of the BHA may not be effective to allow well total depth (or target depth) to be reached.

When a CT string goes into lockup mode, the entire string length is not completely helically-buckled. There are typically one or two locations in the wellbore where the CT is at a critical state, depending on several physical factors, including wellbore/completion design, CT string characteristics, etc. Lock-up developing in these one or two critical locations is sufficient to prevent the CT from advancing further into the wellbore. The location is typically either near surface below the wellhead for most high angle wells or near the heel of a long horizontal well or both. These locations can be identified prior to actual insertion of the CT into the well through analysis using a force modeling software such as COILCADE™, a commercially available product available from Schlumberger Technology Corporation.

Similarly, pipe used to connect the output of wellbores in oil fields including offshore operations may require maintenance to remove residue and/or improve flow. Such systems exercise flexible tubing equipment that experiences similar buckling along the length of the tubing when equipment is introduced to service the pipelines.

SUMMARY

Embodiments relate to an apparatus and a method for delivering a rod in a cylinder including propagating a rod in a cylinder along the interior of the cylinder, and introducing a motion in an orientation of at least one of the followings (orthogonal, parallel to or rotational) to a length of the rod, wherein the motion comprises multiple motion sources along the length of the rod, and wherein the multiple motion sources comprise a control system that controls at least one of the motion sources. Embodiments relate to an apparatus and method for delivering a rod in a cylinder including a cylinder comprising a deviated portion, a rod comprising a length within the cylinder, multiple motion sources positioned along the length of the rod, and a control system in communication with at least one of the motion sources, wherein the control system controls the location and orientation of frictional contact between the rod and cylinder over time.

BRIEF DESCRIPTION OF THE DRAWINGS

Embodiments are further explained in the detailed description that follows, in reference to the noted plurality of drawings by way of non-limiting examples of exemplary embodiments.

DETAILED DESCRIPTION

Figure 1:
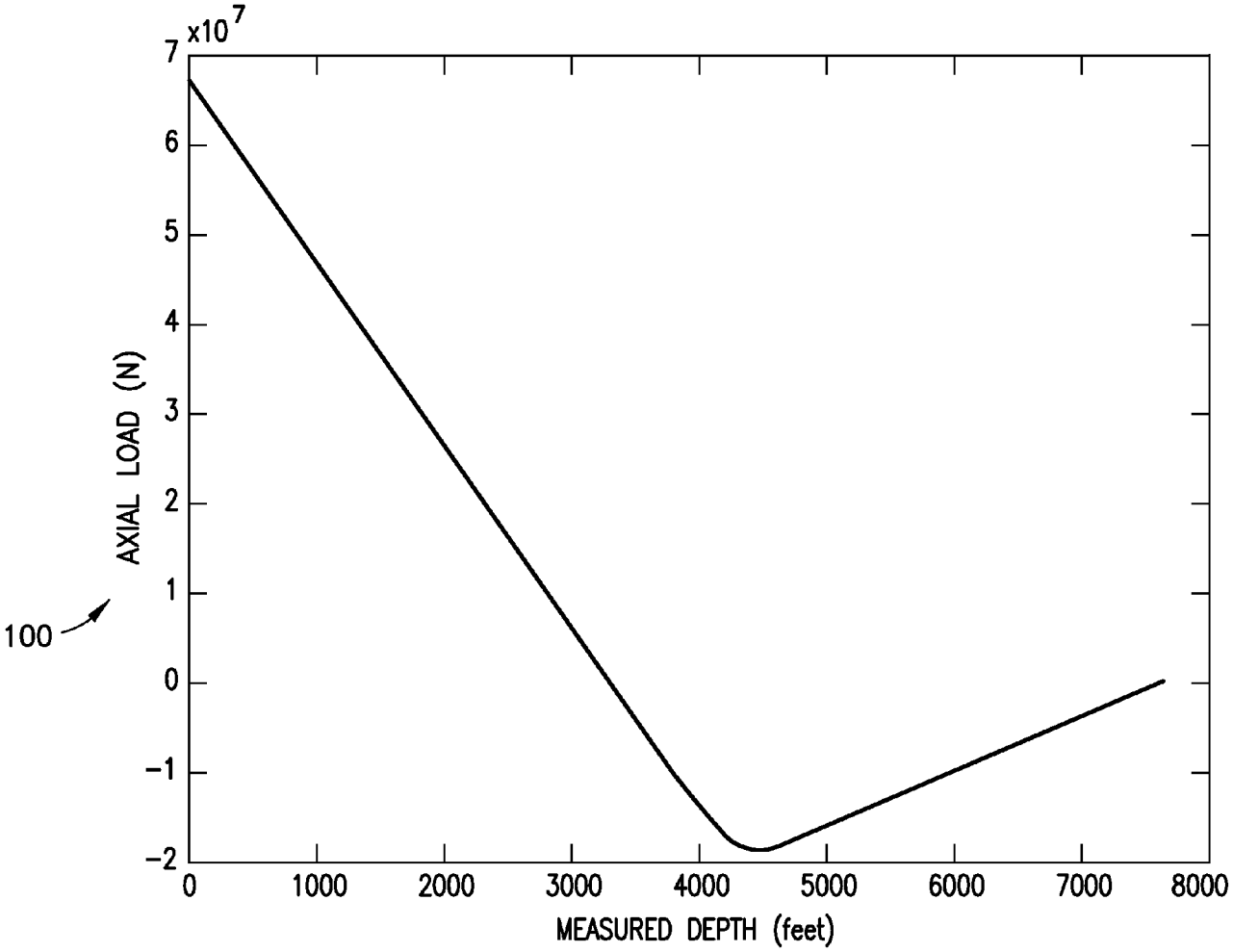
FIG. 1 PRIOR ART
FIG. 1 is a plot of axial load as a function of measured depth of the prior art.
Figure 2:
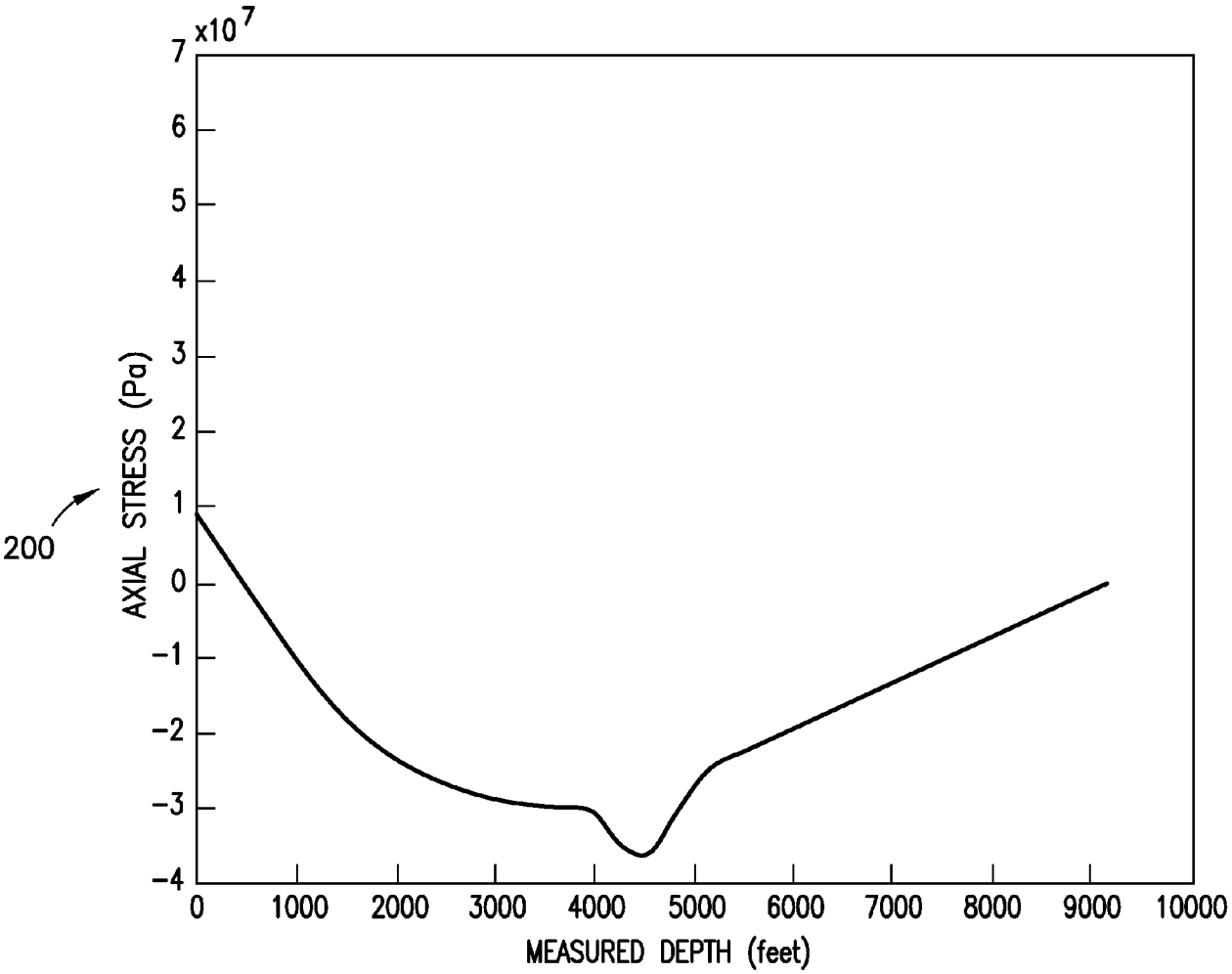
FIG.2 PRIOR ART
FIG. 2 is a plot of axial stress as a function of measured depth of the prior art.

Generally, coiled tubing is selected for its ability to coil on a reel for transport at the surface, to retain some rigidity and integrity as it travels through a pipe or wellbore, to convey material or information, and/or to perform a specialized service at the terminal end of the tubing. Further, coiled tubing is often used in harsh conditions where design parameters must also encompass transport, environmental stewardship, and sturdy, rugged construction specifications. The tubing may be selected for chemical, temperature, and physical constraints. The welds, connectors, surface and terminal components may also be tailored for similar integrity concerns.

Several methods are employed to move the tubing through a wellbore or pipe. Tractors may be used to provide axial motion. The tubing may have an outlet port that may be configured to vibrate as described above. The surface connection may include a component to intentionally vibrate the tubing. The fluid may be introduced to and controlled throughout the tubing to tailor at its flow and the resulting tubing vibration using valves, pumps, and other devices. Embodiments herein provide methods and apparatus to distribute additional vibration along the length of the coiled tubing and to control the various ways vibration may be introduced anywhere in the coiled tubing assembly.

A rod that may benefit from embodiments herein may be hollow and configured to deliver fluid such as coiled tubing. The rod may be solid with no voids in its cross section or it may have a narrow interior hollow void in comparison to its outer diameter. The void may be circular or ellipsoid or eccentric. A rod may be cylindrical in shape, that is, have a primary length and a circular cross section, but it also may feature a cross section that is ellipsoid, square, rectangular, curved, eccentric or indeterminate in nature. The rod may be metallic, ceramic, composite, polymer, a combination thereof, or some other material selected for its flexibility and resilience in harsh environments. A diameter of the rod may be consistent for the length of the rod. The diameter may vary over the length of the rod, for example, it may narrow along the length away from the surface. It may telescope along its length. Further, equipment along the length such as connectors, welds, or valves may also vary its inner and/or outer diameter along the length of the rod. In some embodiments, a rod may that may benefit from embodiments described herein include the deployment of sensors and/or downhole tools (for example, pressure and sampling tools). A rod may also encompass wireline tools including tools travelling through horizontal regions of a wellbore.

Similarly, the rod may be introduced into a cylinder such as a wellbore. The wellbore may be vertical, deviated from vertical, horizontal, or some combination thereof. It may be cased or uncased, in transition between the two or some combination thereof. Also, the cylinder may be a pipe. The pipe may connect multiple wellbores such as in offshore operations. The cross section of the cylinder may be circular. It may also be irregular, ellipsoid, eccentric, or indeterminate along its length. The cross section may vary along the length of the cylinder with regions that are cased, regions that not cased, regions that are perforated and/or fractured or a combination thereof.

Embodiments described herein use single point or distributed (multi-point or continuous) vibration in order to extend the reach of a rod moving through a cylinder. That is, intentionally introducing motion orthogonal to, or parallel to, or rotationally about the forward direction of the tubing improves the likelihood that the tubing will travel through a wellbore instead of succumb to the buckling lock-up described above. The vibration is employed in order to delay or avoid the onset of helical buckling of the coiled tubing string and/or to allow progress into the wellbore in the presence of helically buckled tubing.

Several strategies have been used in order to delay or avoid lock-up. Several different types of vibration are possible. These include:

1) Axial vibration—vibration is induced along the axis of the coiled tubing/wellbore 2) Lateral vibration—vibration is induced orthogonal to the axis of the coiled tubing/wellbore 3) Torsional—rotational vibration is induced about the axis of the coiled tubing/wellbore 4) Lateral rotational—rotational vibration induced about an axis orthogonal to the axis of the coiled tubing/wellbore The vibrations can be used individually or in combination with each other. The vibrations can be phased in order to optimize their effectiveness in extending reach. Further, vibration sources can be located in one or several locations along the length of the coiled tubing. The vibration source can be located at the surface (e.g., at the injector head). Also, the vibration source can be located at or near the end of the CT string (e.g., as an element of the bottomhole assembly, tractor, etc.). The vibration source can also be distributed along a length of the coiled tubing. This could be assembled during the manufacturing process or discrete lengths of the coiled tubing could be joined by a "connector" element which would house the vibration source. In some embodiments, a self-contained module may include a power source (battery, turbine/alternator), electronics, actuator (rotary, linear, hammer drill, etc.). Also, the lengths of tubing between sources of vibration can be different, having different cross-sectional shapes as needed for optimization.

For a vibrator to be effective, the oscillations should be of sufficient amplitude and frequency to propagate to the critical locations within the wellbore where the likelihood of buckling is higher. In long, extended reach wells, locating the vibration source at an intermediate point mid-string of the CT (near the critical location) rather than at the end with other BHA components, would be advantageous. It will also be possible to configure multiple vibration sources in different locations on the CT string should it become necessary.

Methods to introduce vibration can be classified in 3 distinct locations, with different mechanical systems utilized:

1) From surface—can be used with continuous coiled tubing:

a. Axial excitation by modulating the injector speed;

b. Torsional excitation by rotating the injector unit back and forth about the axis of the CT; and/or c. Lateral excitation by moving the injector unit from side to side.

2) From downhole end of CT—can be used with continuous coiled tubing:

a. Mud motor to convert fluid power into vibration (motor configured to provide desired amplitude and frequency). The induced vibration can be lateral (such as introduced by the whirling of the rotor), axial (such as introduced by modulating a flow port as the rotor turns), torsional (such as introduced by modulating the pressure drop across the motor), or a combination of those;

b. Use of a series of pressure relief valves (controlled so as to open/close either totally or partially in a modulated/harmonic fashion) in axial or lateral orientation to pulse the fluid flow;

c. Use of a cam or series of cams controlled by a downhole motor (similar to mud motor idea, would require downhole power and electronics but would allow better control);

d. Use of linear actuator (axial) controlled by a downhole motor or electro-magnets; and/or e. Use of hammer-drill actuator.

3) From distributed vibration module:

a. Placing the vibration source(s) mid-string along the CT length, at an optimal location along the tubing for both length and vibration, maximizes the benefits of the oscillations and requires thoughtful design of the mechanical components. Vibration could be achieved through distributed flow induced vibration actuators.

Some embodiments require a means of connecting discrete lengths of CT to the module. This connection may be mechanical, electrical, or both. To facilitate locating the vibrator mid-string of the CT, some embodiments will use a jointed-spoolable connector. Some embodiments may also feature additional well control barriers to address safety risks.

Figure 5B:
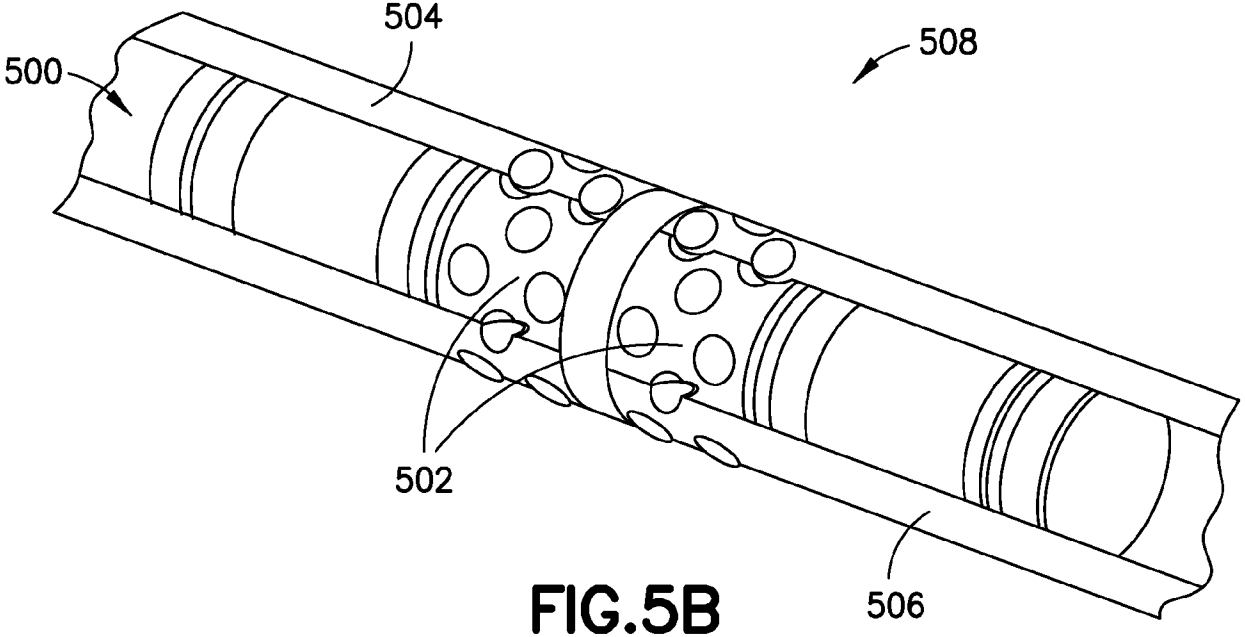
FIGS. 5A, 5B and 5C are renditions of tubing connectors.
Figure 5A:
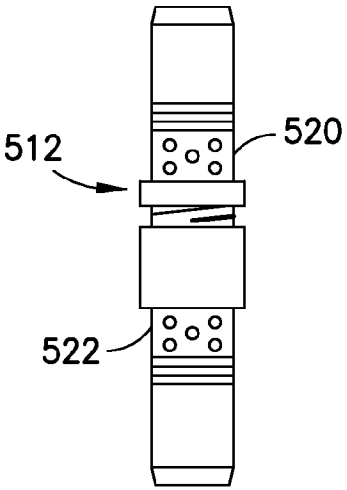
Figure 5C:
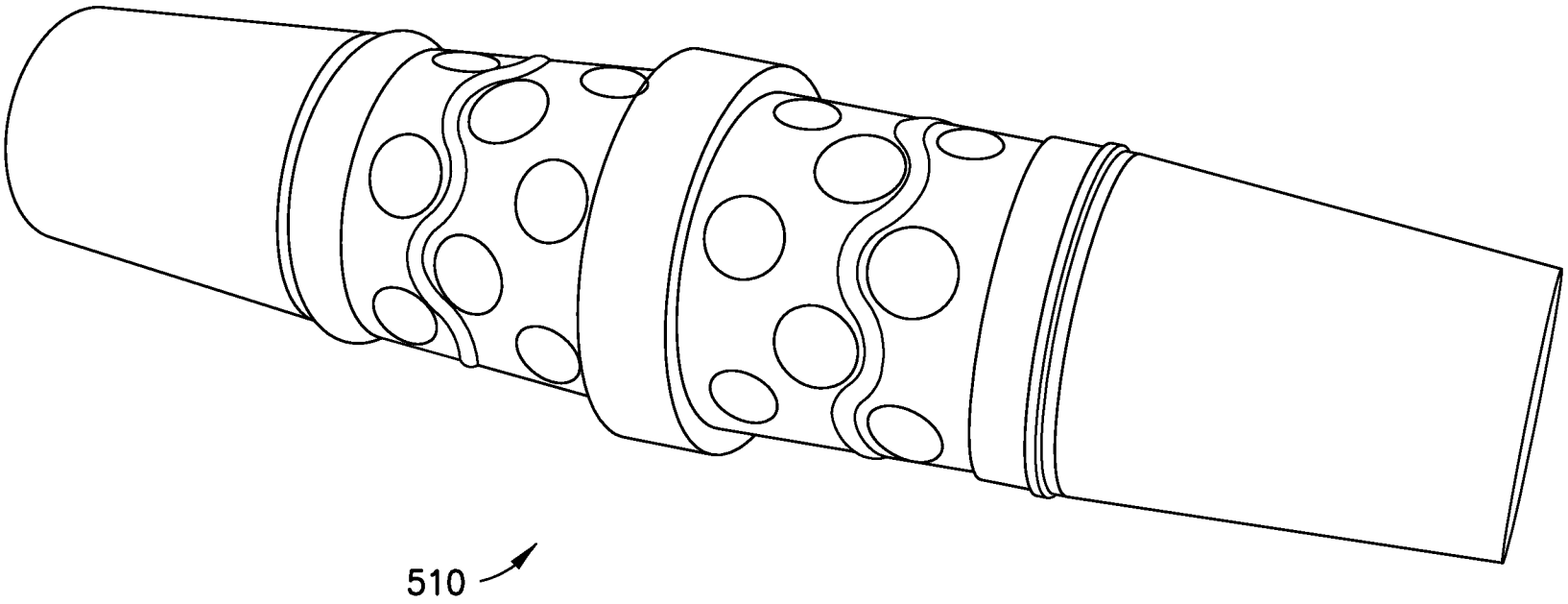

For example, the shape of the module connecting the sections of coiled tubing could be as needed for specified contact with the wellbore. FIG. 5B illustrates an example embodiment of a distributed vibration module 500, utilizing a spoolable connector 502, such as a REELCONNECT™ connection system commercially available from Schlumberger Technology Corporation to attach discrete lengths of coiled tubing 504, 506. The attachment device can include vibration module 500 which may introduce vibration that is axial, lateral, or torsional. One of the major advantages of the REELCONNECT™ connection system is that it allows joining of tubing sections without butt-welding the ends of the sections, saving significant time and reducing assembly process risks. Vibration devices could also be attached via butt-welding. In any event, the connection system must be selected to withstand the induced vibration. Three options for sectional connection devices 508, 510 and 512 are shown in FIGS. 5B, 5C and 5A respectively.

Figure 4:
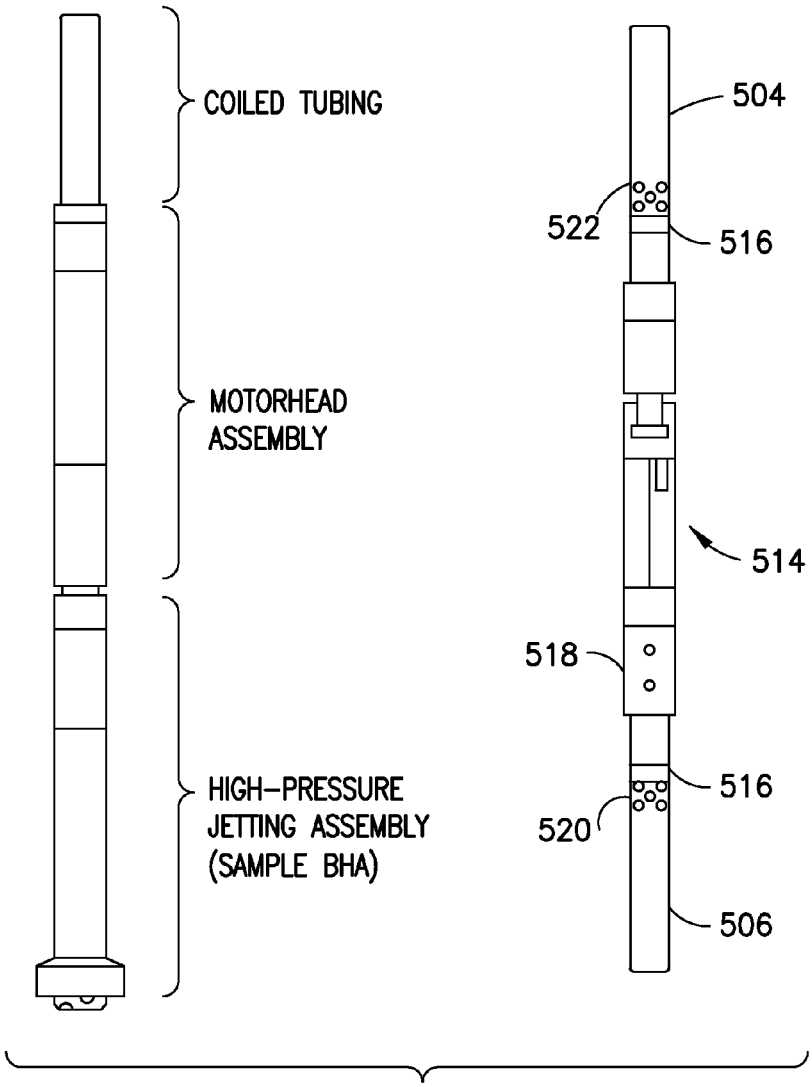
FIG. 4 is a schematic diagram of a connector with a vibration source.

A detailed example of a connector-based system is now provided. To enable connection of a vibration source 514 mid-string of the CT, it will be necessary to use a flush, jointed connector 516 as illustrated in FIG. 4. The connector 516 allows two separate CT strings 504, 506 to be joined together via connectors 516 and vibration source 514, with the outside diameter (OD) the same as the pipe (flushed) to facilitate passing through conventional wellhead equipment and handling with the injector. Well site rig-up and wellbore deployment of the assembly would be simplified if the connector 516 was "spoolable," i.e., the two connected CT lengths 504, 506 could be stored on one work reel as a single string length. The purpose of the jointed nature of the connector 516 becomes apparent in the event sequence described below.

a) Connect 2 (or more) lengths of CT 504, 506 using "spoolable" connector 516 and store into a single work reel
b) Make-up conventional BHA to end of CT string
c) Run CT into well to locate "spoolable" connector 516 above wellhead (below injector)
d) Bleed-off pressure in CT string (downhole checkvalve to hold wellbore pressure)
e) With BOP's closed, access "spoolable" connector 516 and disconnect threaded connection between CT lengths 504, 506
f) Make-up dual, full-bore ball valve assembly 518; then vibration source 514 to lower CT length 506
g) Make-up upper CT length 504 to vibration source 514
h) Re-install surface equipment to wellhead
i) Run complete assembly into well.

Figure 3:
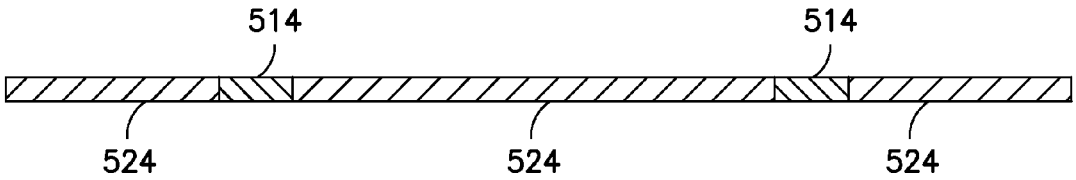
FIG. 3 is a schematic diagram of a coiled tubing string with vibration sources and associated sensors distributed across its length.

A threaded joint on the connector 516 permits separation of the assembly into halves 520, 522, with each half remaining connected to the CT string lengths 504, 506. This threaded joint is non-rotating, allowing make-up to be accomplished without turning either the upper CT string 504 or lower CT string 506. The dual, full-bore ball valve 518 is a redundancy to ensure proper well control during disassembly and equipment rigdown. The integrity of the downhole check valve could be compromised upon completion of the intervention, i.e., may not hold back well pressure. As noted above (and as illustrated in FIG. 3), several vibration sources 514 and associated sensors can be employed along a length of a CT string between coiled tubing sections 524 (such as sections 504, 506) on the CT string.

Figure 6:
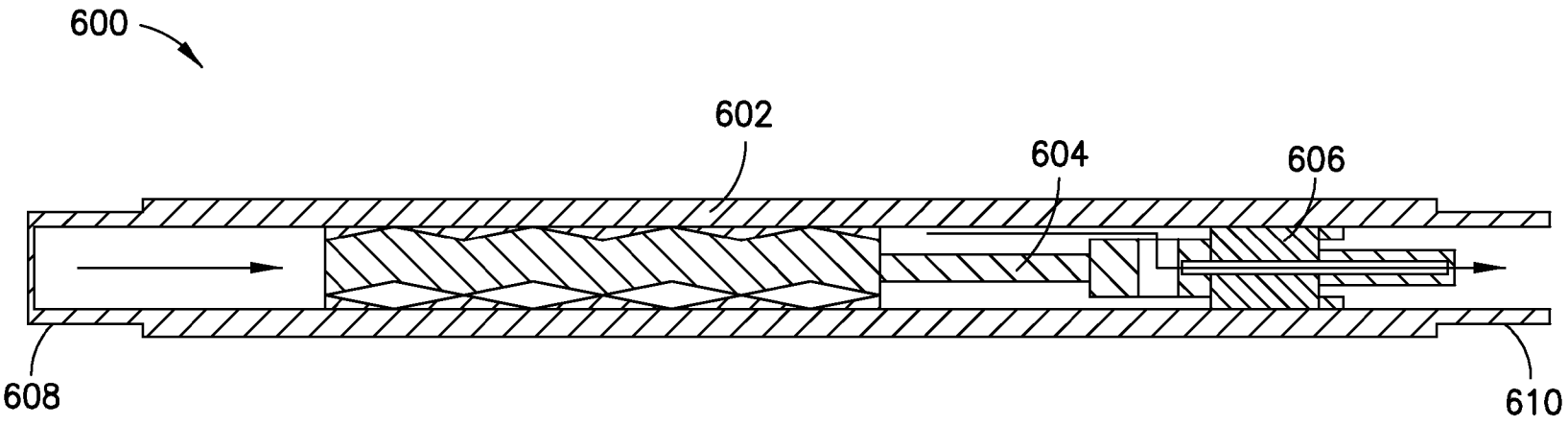
FIG. 6 is a sectional view of a Moineau vibrator device.

Vibration source 514 can include distributed mechanisms, including tractors or rotational devices such as mud motors. Vibration source 514 can also include various pumps, such as a Moineau pump. One possible embodiment of a mechanical system 600 that could be included in the connection device 516 is shown in FIG. 6. This device uses the whirling of a rotor 602 of a Moineau motor as a source of lateral vibration. System 600 also includes a flexible shaft 604 and a thrust bearing 606 along with CT engagement areas 608, 610.

Figure 7:
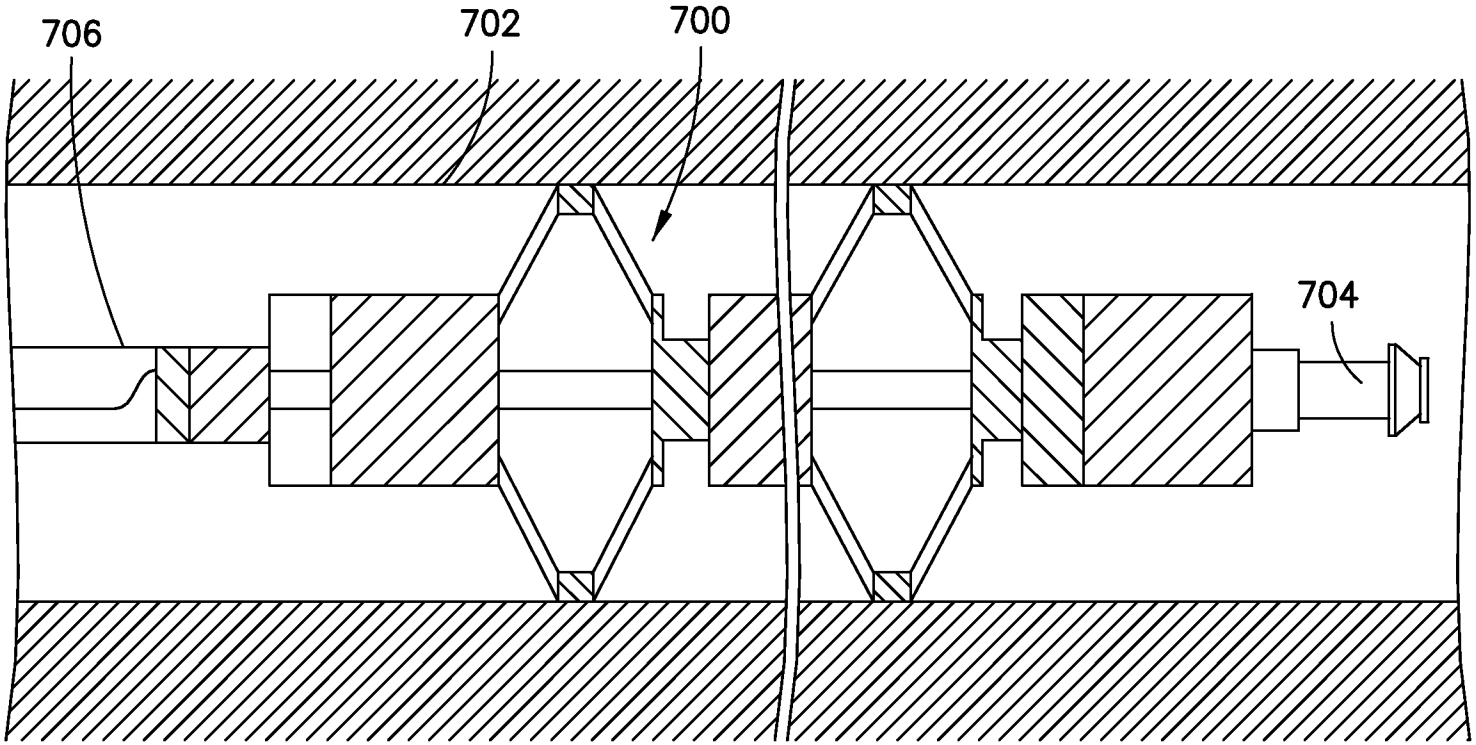
FIG. 7 is a sectional view of a tractor.

FIG. 7 illustrates another possible embodiment using the attachment method to deploy distributed tractors or rotation mechanisms such as mud motors as vibration sources 514 in a CT string. FIG. 7 is a schematic of a general tractor 700 in a borehole 702. Tractors 700 enable, if placed at appropriate locations along the CT string, the reach of coiled tubing systems to become limitless from a load transfer perspective (though pressure drop and flow limitations could limit reach at some length). Rotation of the coiled tubing string in the horizontal section could significantly decrease the component of friction force in the axial direction. This could significantly delay the onset of helical buckling and extend reach. In this situation, it may be desirable to not rotate a bottom hole assembly (BHA) 704—this could be achieved through placement of a swivel joint above BHA 704. The various mechanisms could also be used in combination. If using multiple rotation mechanisms, it may be desirable to rotate different sections of CT in different directions. In one possible implementation, this could limit the total torsional frictional load. Moreover, it will be understood that tractor 700 could be placed between two CT lengths instead of, or in addition to, being placed between a CT length 706 and BHA 704.

Another component that could be selected as a vibration source 514 in a connection device is a pressure pulse system (Such as POWERPULSE™ which is commercially available from Schlumberger Technology Corporation) or other pulsed power fluid delivery systems that periodically open and close the main flow to generate pressure pulse on coiled tubing. A valve that is controlled for vibration generated by the pressure drop created by changes in fluid flow may be selected in some embodiments. To summarize, most downhole vibration devices can be used as vibration sources 514 with a connection device.

An additional application of vibration sources 514 (including distributed rotation mechanisms, tractors, and/or vibration modules) is deployment of completions (typically, lower completions) in deviated wellbores. Vibration sources 514 could include the use of distributed tractors or rotation mechanisms (e.g., mud motors). An additional application of distributed mechanisms (vibration, tractor, or rotation) as vibration sources 514 is deployment of completions in deviated wellbores. Currently, without the use of vibration sources 514, such deployments are not possible on coiled tubing, as the frictional loads required to push heavy completions (in addition to the frictional load of the tubing itself) into the wellbores are too large—the coiled tubing would lock-up. The deployment of vibration sources 514 including distributed tractors, vibration modules, and/or rotation mechanisms would significantly reduce the axial friction, allowing coiled tubing to deploy these completions. During deployment, if rotation of a section of the completion is not desirable it can be prevented by placing a swivel joint above the section of the completion to prevent it from rotation. This can save significant time/cost as compared to deploying these completion strings on drillpipe. If the coiled tubing were still not able to push in the entire completion, it is possible that the completion could be deployed in stages, with each stage being short/light enough to be conveyed on CT. While this would require multiple sequences of running in and out of the hole, the speed of running in and out of the hole on CT (as compared to tripping in/out on drillpipe) may justify this deployment method.

Overall, tailoring relative motion of the rod with respect to the relatively rigid cylinder is desirable. Additional devices may be appropriate for some embodiments. For example, vibration source 514 including a magnet based system using two sets of magnets that are made to rotate relative to each other and convert the rotation into a modulated axial force may be desirable for some embodiments as it minimizes the effect on the fluid flow. Also a vibration source 514 based on an agitator-based system with openings that are designed to open and close in a modulated fashion and are distributed across the circumference of the rod may be desirable for some embodiments. Additionally a vibration source 514 can be created by modifying a surface of the rod to create a wave-like disturbance along the length of the tubing as the fluid goes through.

Control may be helpful, such as synchronization of or tailoring for vibration decay along the length of the tubing for multiple vibration modules. Appropriately synchronizing vibration may use sensing devices located along the length of the CT string (either in the vibration modules, in a fiber optic cable, or through other means) to sense the excitation state of the string. The distributed vibration modules may also include sensors to monitor wellbore conditions. The information from the various sensors could be communicated via fiber optic cable (iCoil), wirelessly, through an electrical cable, or other means. Based on the sensor information, downhole actuation of the vibration sources 514 can be adjusted to control the synchronization of the various vibration source 514 (for example, by adjusting the flow into a vibration source 514).

Figure 8:
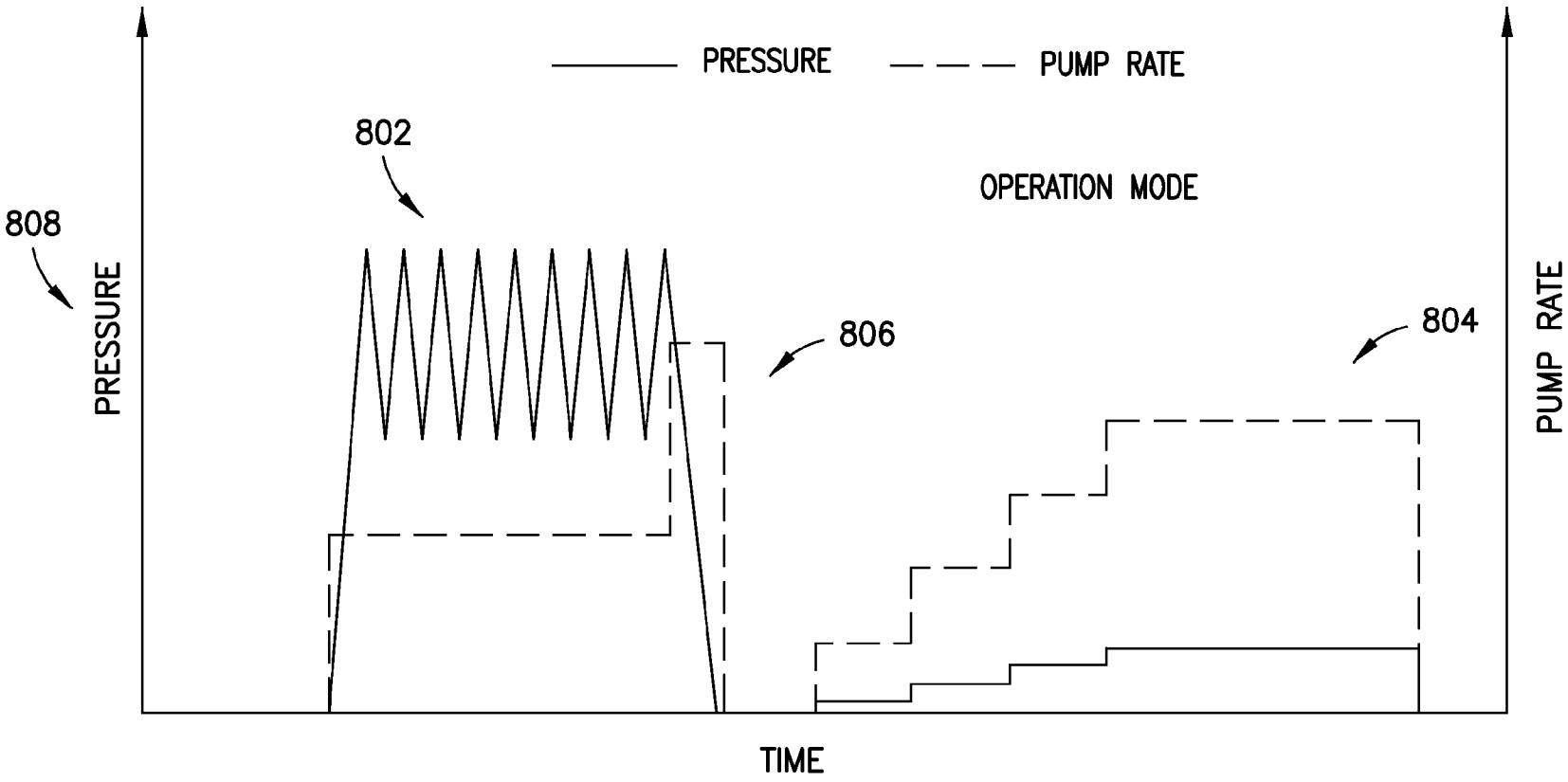
FIG. 8 is a plot of pump rate and pressure as a function of time for vibration and operation modes.

An additional embodiment includes sensors in these vibration modules in order to both extend reach through vibration and monitor conditions in the wellbore through the sensors. The sensors could include pressure, temperature, vibration such as accelerometers and gyros, tension/compression through strain gauges or other means, and/or fluid monitoring. Another embodiment includes the sensors without the vibration modules when reach extension is not required, for example. An embodiment with vibration/sensor modules is depicted in graph 800 in FIG. 8.

In some embodiments, it may be desirable for the vibration source 514 to be "on/off" switchable, i.e., vibrations are only produced when pumping during the critical stages of the RIH process. This will ensure that it does not interfere with or is "invisible" to the intended objective of the intervention (e.g., pumping acid, wellbore cleanout, etc.) once the target depth is reached. Simply, the vibration effects are only required during conveyance. In one possible implementation, a vibration source 514 associated with coiled tubing can be controlled by varying flow rates though the coiled tubing. Essentially, the tool has two modes: vibration mode 802 and normal operation mode 804. The function can be switched from vibration mode 802 to operation mode 804 by pumping at a certain threshold rate 806. If necessary, it can be shifted back to vibration mode 802 from operation mode 804 by the same means. Graph 800 schematically shows the correlation between tool modes 802, 804, pressures 808 and pump rates 810.

An additional control component includes acknowledging that a vibration source 514, including a tool, will generate an oscillating axial force when pumping at a certain pump rate. This pump rate is predetermined per the job requirement, but it is adjustable at surface prior to running the vibration source 514 into the wellbore. The magnitude and frequency of the oscillating force is adjustable as well, predetermined through modeling analysis before RIH. This ensures that the proper oscillations are developed for a given wellbore/CT configuration. The adjustability can be accomplished at surface prior to running the tool into the wellbore and need not necessarily be adjustable "on-demand" when the tool is in the wellbore.

In some of the embodiments explained above, the only component that would require a "spoolable" feature would be the connector itself. The rest of the assembly, such as a dual ball valve and vibrator, may be conventionally constructed as with other bottom hole assemblies. Furthermore, because these are assembled below the stripper (WHP packoff seal), an OD flushed with the CT diameter is not a requirement.

The advantages of some of the embodiments herein are numerous. Coiled tubing operations and pipe maintenance programs including clearing pipes generally could benefit from this. Long distance tubing may be a benefit for some embodiments. Using the tubing for operations that traditionally require more rigid pipe-like equipment is a benefit. Embodiments described herein could also enable deployment of stiff, heavy lower completions in deviated wellbores.

We claim:

1. A method for propagating a coiled tubing string in a wellbore, comprising:

propagating the coiled tubing string along an interior of the wellbore; and introducing a motion to a length of the coiled tubing string, wherein the introducing occurs via one or more vibration sources included in one or more coiled tubing connection devices connecting lengths of coiled tubing in the coiled tubing string wherein at least one vibration source of the one or more vibration sources is a valve;

monitoring the wellbore using one or more sensors associated with the coiled tubing and adjusting the one or more vibration sources based on information from the one or more sensors; and extending a reach of the coiled tubing along the interior of the wellbore with the one or more vibration sources wherein the one or more vibration sources provide vibration that is one or more of: axial vibration, lateral vibration, torsional vibration, and combinations thereof.

2. The method of claim 1, wherein introducing a motion includes one or more of:

introducing motion in an orientation orthogonal to the length of the coiled tubing string;

introducing motion in an orientation parallel to the length of the coiled tubing string; and introducing motion in an orientation that is rotational with regard to the length of the coiled tubing string.

3. The method of claim 1, further comprising:

utilizing a control system to control at least one of the one or more vibration sources.

4. The method of claim 1, wherein the introducing a motion comprises one or more of:

using a tractor;

using a mud motor;

using a pressure relief valve; and using a pressure pulse system.

5. The method of claim 1, wherein introducing a motion to a length of the coiled tubing string includes:

employing a control system in communication with the one or more vibration sources.

6. The method of claim 1, further comprising introducing a second motion along the length of the coiled tubing string.

7. An apparatus for delivering coiled tubing in a wellbore, comprising:

At least one vibration source included in a spoolable connection device and positioned along a length of the coiled tubing, the at least one vibration source being configured to receive commands formulated from information received from at least one sensor associated with the coiled tubing and wherein the at least one vibration source is a valve and extends a reach of the coiled tubing along an interior of the wellbore.

8. The apparatus of claim 7, wherein the at least one vibration source is configured to receive commands from a control system in communication with the at least one sensor.

9. The apparatus of claim 8, wherein an operation of the at least one vibration source is configured to be synchronized with an operation of a second vibration source positioned along the length of the coiled tubing by the control system.

10. The apparatus of claim 7, wherein the coiled tubing comprises one or more of metal, polymer, ceramic, and composite.

11. The apparatus of claim 7, further comprising one or more of:

pressure tools, and sampling tools.

12. The apparatus of claim 7, further comprising at least one second vibration source positioned along a second length of the coiled tubing between a beginning and an end of the coiled tubing.

13. The apparatus of claim 12, wherein the at least one second vibration source provides vibration that is one or more of:

axial, lateral, and torsional.

14. The apparatus of claim 12, wherein the at least one vibration source and the at least one second vibration source are configured to be controlled individually by a control system.

15. An apparatus for delivering a coiled tubing string into a wellbore, comprising:

at least one vibration source positioned in a coiled tubing connection device along a length of the coiled tubing string, the at least one vibration source extending a reach of the coiled tubing along the interior of the wellbore wherein the at least one vibration source is a valve; and a control system housed along a length of the coiled tubing string in communication with the at least one vibration source, the control system being configured to receive information from sensors associated with the coiled tubing string wherein the at least one vibration source provide vibration that is one or more of: axial vibration, lateral vibration, torsional vibration, and combinations thereof.

16. The apparatus of claim 15, wherein the control system controls the operation of the at least one vibration source.

17. The apparatus of claim 15, wherein the coiled tubing string comprises metal, polymer, ceramic, or composite.

18. The apparatus of claim 15, further comprising one or more of:

pressure tools, and sampling tools.

19. The apparatus of claim 15, further comprising at least one second vibration source.

20. The apparatus of claim 19, wherein the at least one second vibration source provides motion that is one or more of:

axial, lateral, and torsional.

21. The apparatus of claim 19, wherein the control system controls the vibration sources individually.

22. The apparatus of claim 19, wherein the control system controls the vibration sources collectively.

23. The apparatus of claim 22, wherein the control system optimizes the vibrations in relative phase to each other.

24. The method of claim 1, wherein the one or more coiled tubing connection devices is a spoolable connector.

* * * * *